US008132325B2

(12) United States Patent
Arrell et al.

(10) Patent No.: US 8,132,325 B2
(45) **Date of Patent: *Mar. 13, 2012**

(54) CO-FORGED NICKEL-STEEL ROTOR COMPONENT FOR STEAM AND GAS TURBINE ENGINES

(75) Inventors: Douglas J. Arrell, Oviedo, FL (US); Allister W. James, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 1372 days.

This patent is subject to a terminal disclaimer.

(21) Appl. No.: 11/786,026

(22) Filed: Apr. 10, 2007

(65) Prior Publication Data

US 2008/0253890 A1 Oct. 16, 2008

(51) Int. Cl.
*B23P 15/02* (2006.01)

(52) U.S. Cl. ..... 29/889.7; 29/889; 29/889.2; 416/204 R; 416/244 R

(58) Field of Classification Search ..... 29/889–889.72; 416/204 R, 244 R, 204 A, 244 A
See application file for complete search history.

(56) References Cited

U.S. PATENT DOCUMENTS

| | | | | |
|---|---|---|---|---|
| 4,058,417 | A | 11/1977 | Bicicchi et al. | |
| 4,479,293 | A | 10/1984 | Miller et al. | |
| 4,680,160 | A | 7/1987 | Helmink | |
| 4,699,671 | A | 10/1987 | Jacobs et al. | |
| 4,743,165 | A | 5/1988 | Ulrich | |
| 4,985,201 | A | 1/1991 | Chang et al. | |
| 5,061,154 | A | 10/1991 | Kington | |
| 5,161,950 | A * | 11/1992 | Krueger et al. | 416/204 R |
| 6,120,727 | A | 9/2000 | Asaka et al. | |
| 6,350,325 | B1 | 2/2002 | Ewald et al. | |
| 6,499,946 | B1 | 12/2002 | Yamada et al. | |
| 6,767,649 | B2 | 7/2004 | Staubli et al. | |
| 6,962,483 | B2 | 11/2005 | Ganesh et al. | |
| 7,137,787 | B2 | 11/2006 | James | |
| 7,950,146 | B2 * | 5/2011 | Arrell et al. | 29/889.2 |
| 2005/0106012 | A1 | 5/2005 | Scarlin | |

FOREIGN PATENT DOCUMENTS

| | | |
|---|---|---|
| EP | 0062449 A2 | 10/1982 |
| JP | 11047955 | 2/1999 |

* cited by examiner

*Primary Examiner* — Richard Chang

(57) ABSTRACT

A method of forming a rotor for a turbine engine such that the rotor is formed of two materials including: an inner disk formed from a first material, such as steel, and an outer ring formed from a second material, such as a nickel alloy, having a larger thermal expansion coefficient than the first material forming the inner disk. The ring may include an inner aperture having a conical shape, and the disk may have an outer surface with a conical shape and a diameter with a portion that is larger than a portion of the ring. The ring may be heated such that the aperture expands to a size greater than the largest diameter of the inner disk. The ring may be positioned over the disk and allowed to cool to allow the ring to be attached to the disk. The ring and disk may then be co-forged.

16 Claims, 3 Drawing Sheets

CO-FORGED NICKEL-STEEL ROTOR COMPONENT FOR STEAM AND GAS TURBINE ENGINES

FIELD OF THE INVENTION

This invention is directed generally to turbine engines, and more particularly to rotors usable in turbine engines.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies and turbine rotors to these high temperatures. As a result, turbine rotors must be made of materials capable of withstanding such high temperatures. Steel rotors have begun to be changed to nickel-based alloys to compensate for these high temperatures. However, rotors are large components and forming the rotors entirely of nickel-based alloys is expensive. Thus, a need exists for a more cost efficient turbine rotor having superior thermal properties.

SUMMARY OF THE INVENTION

This invention is directed to a turbine rotor system for forming a turbine rotor that is usable in a turbine engine. The turbine rotor may be formed from two or more materials such that the material exposed to the hot gas path has superior thermal properties and resistance to the high temperatures found in the hot gas path of a turbine engine. In at least one embodiment, the material forming the outer aspect of the turbine rotor may have increased thermal properties for more effectively handling exposure to the high temperatures of the gases in the hot gas path.

The turbine rotor system may include a method of forming a turbine rotor usable in a turbine engine including positioning a ring formed from a first heat resistant alloy with a first thermal expansion coefficient and including an inner aperture having a first changing diameter proximate to a disk formed from a second alloy with a second thermal expansion coefficient less than the first thermal expansion coefficient with an outer changing diameter that includes at least a portion of the outer changing diameter that is greater than a portion of the first changing diameter of the inner aperture of the ring. An outer surface of the outer changing diameter of the disk may be generally conical shaped and an inner surface of the first changing diameter of the ring may be generally conical shaped. The ring may be heated such that the first changing diameter may grow to be larger than the outer changing diameter of the disk due to thermal expansion. The ring may then be placed around the disk such that the outer surfaces of the ring and disk are substantially flush with each other. The ring may be allowed to cool such that the inner surface of the inner aperture of the ring contacts the outer surface of the disk. The ring and disk may then be co-forged together.

The ring may be formed from a first heat resistant alloy, such as, but not limited to, a nickel alloy. The disk may be formed from less costly materials, such as, but not limited to, steel. In another embodiment, the ring need not be heated by itself. Rather, the ring and disk may be heated together such that the thermal expansion of the ring exceeds the thermal expansion of the disk. In another embodiment, the ring and disk may be keyed to prevent decoupling during the forging process. The inner aperture of the ring may include a key, and the outer changing diameter of the disk may include a keyway sized to receive the key. In an alternative embodiment, the outer changing diameter of the disk may include a key, and the inner aperture of the ring may include a keyway sized to receive the key.

An advantage of this invention is that a rotor may be formed from two or more materials such that outer aspects of the rotor may be formed from materials having superior thermal properties and inner aspects of the rotor may be formed from less expensive materials.

Another advantage is that the material forming the disk may have superior low temperature properties, particularly with respect to fracture toughness and strength.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
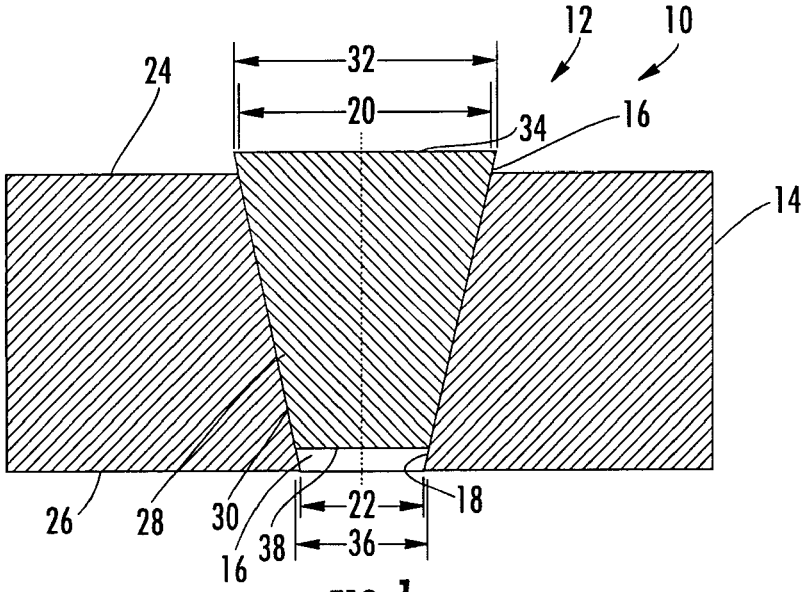
FIG. 1 is a cross-sectional view of a partially formed airfoil rotor for a turbine engine in which the rotor is formed from an outer ring surrounding an inner steel disk before being heated.

As shown in FIGS. 1-6, this invention is directed to a turbine rotor system 10 for forming a turbine rotor 12 that is usable in a turbine engine. The turbine rotor 12 may be formed from two or more materials such that the material exposed to the hot gas path has increased resistance to the high temperatures found in the hot gas path. In at least one embodiment, the material forming the outer aspect of the turbine rotor 12 may have increased thermal properties for more effectively handling exposure to the high temperatures of the gases in the hot gas path.

The turbine rotor system 10 may include an outer ring 14 formed from a first material, such as a alloy, having a first coefficient of thermal expansion. The material may be, but is not limited to, a nickel alloy or other appropriate material. The outer ring 14 may include an inner aperture 16. The inner aperture 16 may have changing diameters such that a diameter of a portion of an inner surface 18 of the inner aperture 16 is less than diameters of other aspects of the inner surface 18. In one embodiment, the inner aperture 16 may have a generally conical shape with varying diameters including a first diameter 20 at a first side 24 and a second diameter 22 at a second side 26. The first diameter 20 may be the largest diameter of the inner aperture 16, and the second diameter 22 may be smallest diameter of the inner aperture 16. The first diameter 20 may be larger than the second diameter 22.

The turbine rotor system 10 may also include an inner disk 28. The inner disk 28 may be formed from a material, such as a alloy, having sufficient thermal characteristics to handle exposure to the high temperatures of the hot gas path, yet be less costly than the materials forming the ring 14. In at least one embodiment, the inner disk 28 may be formed from materials such as, but not limited to, steel or other appropriate materials. The disk 28 may include an outer surface 30 configured to engage the inner surface 18 of the aperture 16. The outer surface 30 may have a changing diameter across the disk 28. In one embodiment, the outer surface 20 may have a generally conical shape that corresponds with the inner aperture 16 such that each surface is positioned at the same angle thereby allowing the surfaces to mate with each other. The outer surface 20 may include a third diameter 32 at a third side 34 having the largest diameter across the disk 28 and a fourth diameter 36 at a fourth surface 38 having the smallest diameter across the disk 28. The outer surface 20 may be sized such that the first diameter 20 of the ring 14 is less than the third diameter 32 of the disk 28. The outer surface 20 may also be sized such that the second diameter 22 of the ring 14 is less than the fourth diameter 36 of the disk 28. In addition, the first diameter 20 of the ring 14 may be greater than the fourth diameter 36 of the disk 28.

Figure 2:
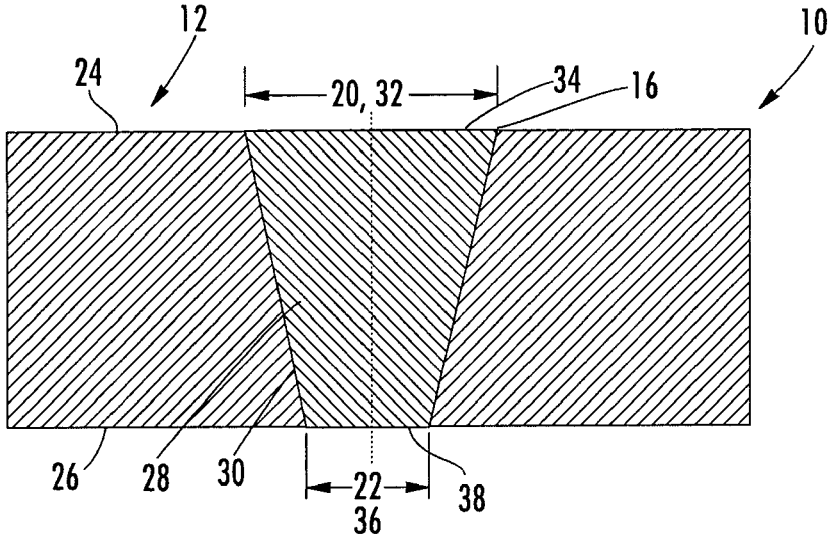
FIG. 2 is a cross-sectional view of a partially formed airfoil rotor for a turbine engine in which the rotor is formed from an outer ring surrounding an inner steel disk after being heated.
Figure 3:
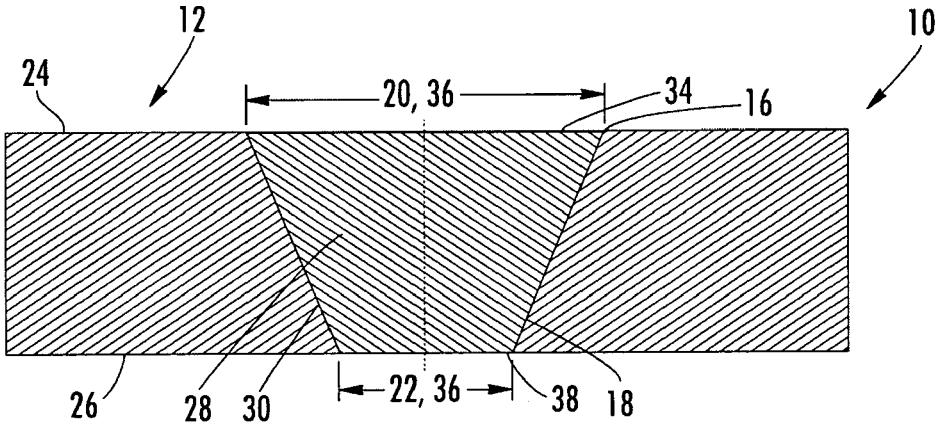
FIG. 3 is a cross-sectional view of a partially formed airfoil rotor for a turbine engine in which the rotor is formed from an outer ring surrounding an inner steel disk after being heated and forged.

The ring 14 and disk 28 may be attached together by first placing the disk 28 into the inner aperture 16 so that the first and third sides 24, 34 are proximate to each other yet not flush with each other and the second and fourth sides 26, 38 are proximate to each other yet not flush with each other. As shown in FIG. 1, the first and third sides 24, 34 are nearly coplanar with each other, and the second and fourth sides 26, 38 are nearly coplanar with each other as well. The ring 14 and disk 28 may then be attached to each other via thermal expansion. In one embodiment, the ring 14 may be heated to expand the size of the aperture 16 such that the first diameter 20 of the ring 14 is equal to or greater than the third diameter 32 of the disk 28, and the second diameter 22 is equal to or greater than the fourth diameter 36 of the disk 28. The disk 28 may then be positioned relative to the ring 14, as shown in FIG. 2, such that the first side 24 of the ring 14 is generally coplanar with the third side 34 of the disk 28, and the second side 26 of the ring 14 is generally coplanar with the fourth side 38 of the disk 28. In another embodiment, both the ring 14 and the disk 28 may be heated together in embodiments where the thermal coefficient of the ring 14 exceeds the thermal coefficient of the disk 28, such as in embodiments in which the ring is formed from a nickel alloy and the disk is formed from steel. These processes may be repeated to add additional rings. The ring 14 and disk 28 may be co-forged to produce the final turbine rotor 12, as shown in FIG. 3. The overall outer diameter of the outer ring 14 increase as well as the diameters 20, 22, 32 and 36. The forging operation may be via an open or closed die process, via an isothermal forging process, or other appropriate method.

Figure 4:
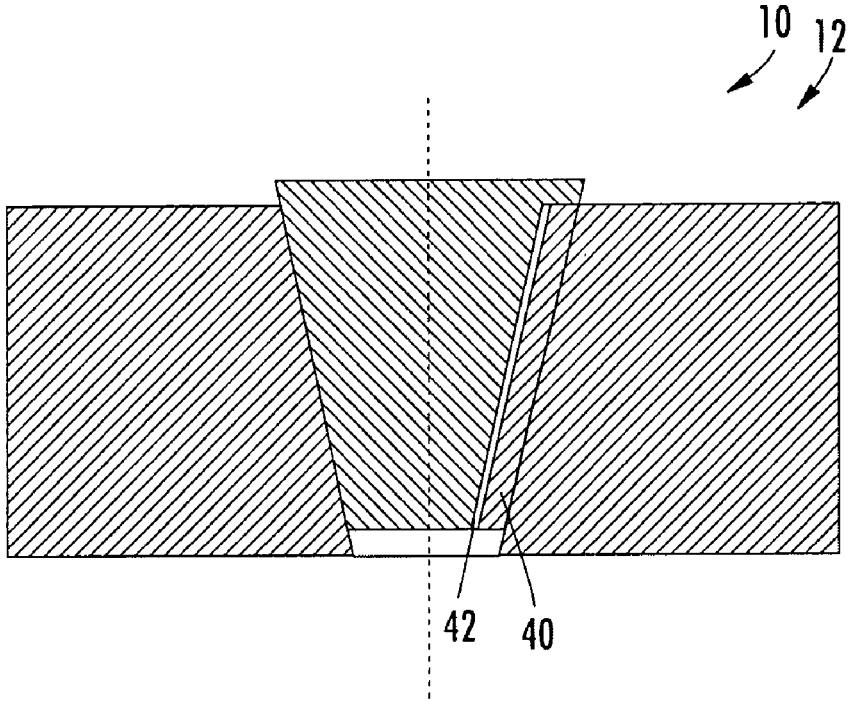
FIG. 4 is a cross-sectional view of an alternative embodiment of the rotor.
Figure 5:
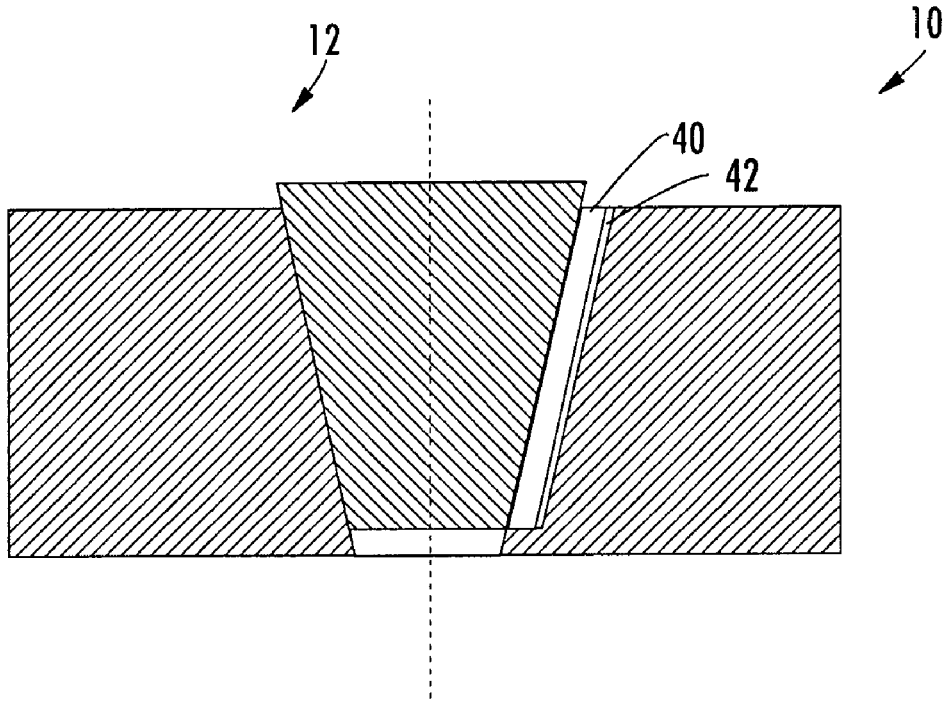
FIG. 5 is a cross-sectional view of another alternative embodiment of the rotor.

In another embodiment, the rotor system 10 may include additional devices to prevent decoupling during the forging process. In particular, as shown in FIG. 4, the inner aperture 16 of the ring 14 may include a key 40, and the outer surface 30 of the disk 28 may include a keyway 42 sized to receive the key 40. In an alternative embodiment, as shown in FIG. 5, the outer surface 30 of the disk 28 may include a key 40 and the inner aperture 16 of the ring 14 may include a keyway 42 sized to receive the key 40.

Figure 6:
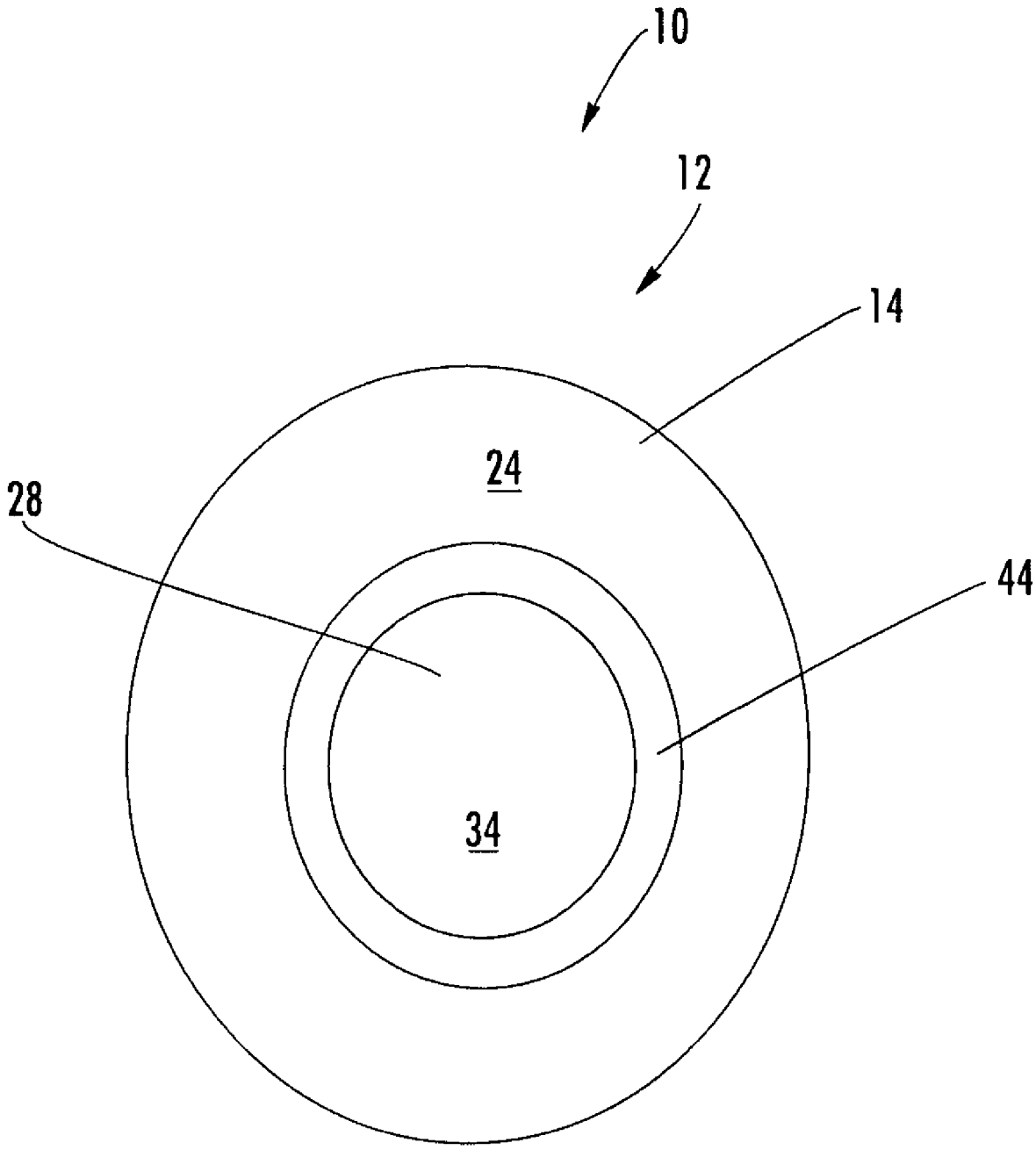
FIG. 6 is a top view of an alternative embodiment of the rotor with an intermediate ring positioned between the nickel alloy and the steel.

As shown in FIG. 6, the turbine rotor 12 may be formed from a disk 28, an intermediate ring 44 and an outer ring 14. The intermediate ring 44 may be sized and configured as the outer ring 14 previously discussed. The intermediate ring 44 may be attached to the disk 28 in the same manner as the outer ring may be attached to the disk 28, as previously discussed. The intermediate ring 44 may be formed from materials, such as, but not limited to, a superalloy weaker than the material used to form the outer ring 14, a nickel-iron based super alloy or other appropriate material. The intermediate ring 44 may be capable of reducing the formation of detrimental phases due to diffusional interactions at the steel-nickel interface.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A method of forming a turbine rotor usable in a turbine engine, comprising:

positioning an outer ring formed from a first heat resistant alloy with a first thermal expansion coefficient and including an inner aperture having a first changing diameter proximate to an inner disk formed from a second alloy with a second thermal expansion coefficient less than the first thermal expansion coefficient with an outer changing diameter that includes at least a portion of the outer changing diameter that is greater than a portion of the first changing diameter of the inner aperture of the ring;

wherein an outer surface of the outer changing diameter of the inner disk is generally conical shaped;

wherein an inner surface of the first changing diameter of the ring is generally conical shaped;

heating the ring such that the first changing diameter grows to be larger than the outer changing diameter of the inner disk due to thermal expansion;

placing the ring around the inner disk and allowing the ring to cool such that the inner surface of the inner aperture of the ring contacts the outer surface of the inner disk; and co-forging the ring and inner disk together.

2. The method of claim 1, wherein positioning the ring formed from the first heat resistant alloy comprises positioning the ring formed from the first heat resistant alloy, wherein the ring is formed from a nickel alloy.

3. The method of claim 2, wherein positioning the inner disk formed from a second alloy comprises positioning the inner disk formed from a second alloy, wherein the inner disk is formed from steel.

4. The method of claim 1, further comprising heating the ring and inner disk together such that the thermal expansion of the ring exceeds the thermal expansion of the inner disk.

5. The method of claim 1, wherein the ring and inner disk are keyed to prevent decoupling during the forging process.

6. The method of claim 5, wherein the inner aperture of the ring includes a key and the outer changing diameter of the inner disk includes a keyway sized to receive the key.

7. The method of claim 5, wherein the outer changing diameter of the inner disk includes a key and the inner aperture of the ring includes a keyway sized to receive the key.

8. The method of claim 1, further comprising positioning an intermediate ring between the inner disk and the outer ring.

9. A method of forming a turbine rotor usable in a turbine engine, comprising:

positioning an outer ring formed from a nickel alloy and including an inner aperture having a first changing diameter proximate to an inner disk formed from steel with an outer changing diameter that includes at least a portion of the outer changing diameter that is greater than a portion of the first changing diameter of the inner aperture of the ring;

wherein an outer surface of the outer changing diameter of the inner disk is generally conical shaped;

wherein an inner surface of the first changing diameter of the ring is generally conical shaped;

heating the ring such that the first changing diameter grows to be larger than the outer changing diameter of the inner disk due to thermal expansion;

placing the ring around the inner disk and allowing the ring to cool such that the inner surface of the inner aperture of the ring contacts the outer surface of the inner disk; and co-forging the ring and inner disk together.

10. The method of claim 9, further comprising heating the ring and inner disk together such that the thermal expansion of the ring exceeds the thermal expansion of the inner disk.

11. The method of claim 9, wherein the ring and inner disk are keyed to prevent decoupling during the forging process.

12. The method of claim 11, wherein the inner aperture of the ring includes a key and the outer changing diameter of the inner disk includes a keyway sized to receive the key.

13. The method of claim 11, wherein the outer changing diameter of the inner disk includes a key and the inner aperture of the ring includes a keyway sized to receive the key.

14. The method of claim 9, further comprising positioning an intermediate ring between the inner disk and the outer ring.

15. A method of forming a turbine rotor usable in a turbine engine, comprising:

positioning an outer ring formed from a nickel alloy and including an inner aperture having a first changing diameter proximate to an intermediate ring;

positioning the intermediate ring over an inner disk formed from steel with an outer changing diameter that includes at least a portion of the outer changing diameter that is greater than a portion of the first changing diameter of the inner aperture of the ring;

wherein an outer surface of the outer changing diameter of the inner disk is generally conical shaped;

wherein an inner surface of the first changing diameter of the ring is generally conical shaped;

heating the outer ring, intermediate ring and inner disk together such that the first changing diameter grows to be larger than the outer changing diameter of the inner disk due to thermal expansion;

allowing the outer ring and intermediate ring to cool such that the inner surface of the inner aperture of the outer ring contacts the intermediate ring, and the intermediate ring contacts the inner disk; and co-forging the outer ring, the intermediate ring and inner disk together.

16. The method of claim 15, wherein the outer ring, intermediate ring and inner disk are keyed to prevent decoupling during the forging process.

* * * * *